US009507286B2

(12) United States Patent
Shirakata et al.

(10) Patent No.: US 9,507,286 B2
(45) Date of Patent: Nov. 29, 2016

(54) IMAGE FORMING APPARATUS HAVING CHARGING MEMBER FOR CHARGING PHOTOSENSITIVE MEMBER

(71) Applicant: CANON KABUSHIKI KAISHA, Tokyo (JP)

(72) Inventors: Jiro Shirakata, Chigasaki (JP); Tadashi Fukuda, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/092,324

(22) Filed: Nov. 27, 2013

(65) Prior Publication Data

US 2014/0147140 A1 May 29, 2014

(30) Foreign Application Priority Data

Nov. 29, 2012 (JP) ..... 2012-261003

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS

2005/0002681 A1* 1/2005 Takahashi et al. ..... 399/50
2006/0222381 A1* 10/2006 Moriya et al.
2007/0098424 A1* 5/2007 Okada ..... 399/50
2007/0297819 A1* 12/2007 Hagiwara et al.
2008/0085131 A1* 4/2008 Kitazawa et al.

FOREIGN PATENT DOCUMENTS

JP 2002-072634 A 3/2002
JP 2007-033948 A 2/2007

* cited by examiner

*Primary Examiner* — Walter L Lindsay, Jr.
*Assistant Examiner* — Milton Gonzalez
(74) *Attorney, Agent, or Firm* — Rossi, Kimms & McDowell LLP

(57) ABSTRACT

An image forming apparatus having a photosensitive member, a charging member that charges the photosensitive member to form a charged surface on a surface of the photosensitive member, an applying unit that applies to the charging member a charging bias composed of a direct voltage superimposed with an alternating voltage, and a toner image forming unit that forms a toner image on the charged surface. A current flowing through the charging member when the charging bias is applied to the charging member is detected by a current detection unit, and currents of different predetermined frequency components are respectively extracted from the detected current by extraction units. Based on the extracted currents, the alternating voltage of the charging bias is adjusted by an adjustment unit.

6 Claims, 10 Drawing Sheets

IMAGE FORMING APPARATUS HAVING CHARGING MEMBER FOR CHARGING PHOTOSENSITIVE MEMBER

BACKGROUND OF THE INVENTION

Field of the Invention

The present invention relates to an image forming apparatus having a charging member for charging a photosensitive member.

Description of the Related Art

In an electrophotographic or electrostatic recording image forming apparatus, a corona charging unit or other charging unit has conventionally been used to charge an image carrier such as an electrophotographic photosensitive member or an electrostatic recording dielectric member.

In recent years, there has been put into practice a charging unit in which a voltage is applied to a charging member disposed in contact with or in the vicinity of a to-be-charged member (e.g., an image carrier) to thereby charge the to-be-charged member. This charging unit is advantageous in low ozone emission and low power consumption.

Such charging units are classified into two, one of which is a charging unit of DC charging system where only a direct voltage is applied to the to-be-charged member via the charging member to charge the to-be-charged member, and the other of which is a charging unit of AC charging system where an oscillatory voltage having an alternating voltage component and a direct voltage component and having a voltage value that periodically changes with time is applied to charge the to-be-charged member.

The charging unit of AC charging system is excellent in charging uniformity and widely used in recent years. However, the oscillatory voltage applied from the charging member to the to-be-charged member has a voltage value that changes between positive and negative values, so that discharge and reverse discharge are repeated between the charging member and the to-be-charged member. Due to the discharge from the charging member to the to-be-charged member, a surface of the to-be-charged member (e.g., a photosensitive drum) is deteriorated. This poses a problem that the deteriorated surface of the photosensitive drum is worn by friction with a contact member such as a cleaning blade.

To obviate this, many methods have been proposed to properly control the amount of discharge current in the charging unit of AC charging system. For example, an image forming apparatus disclosed in Japanese Laid-open Patent Publication No. 2007-033948 is configured as follows: The charging member is applied with an alternating voltage having a peak-to-peak voltage lower than a discharge starting voltage at which discharge is started between the charging member and the photosensitive member, and the peak-to-peak voltage of the alternating voltage is increased stepwise. A current flowing through the charging member when each of alternating voltages of peak-to-peak voltages is applied to the charging member is detected, and the detected current is decomposed into integer-order frequency components. Then, the peak-to-peak voltage where the fifth or higher order frequency component becomes a peak is set as a peak-to-peak voltage of the alternating voltage to be applied to the charging member for image formation.

However, with the method disclosed in Japanese Laid-open Patent Publication No. 2007-033948, electric potential on a surface of the photosensitive member changes while control is being performed based on this method since the peak-to-peak voltage of the alternating voltage applied to the charging member is changed stepwise from a voltage lower than the discharge starting voltage. When image formation is performed in a state where the electric potential on the surface of the photosensitive member changes, toner fogging or density unevenness is generated. This poses a problem that the alternating voltage applied to the charging member cannot be adjusted in a period in which a charging operation for image formation is being performed.

SUMMARY OF THE INVENTION

The present invention provides an image forming apparatus comprising a photosensitive member, a charging member configured to charge the photosensitive member to thereby form a charged surface on a surface of the photosensitive member, an applying unit configured to apply to the charging member a charging bias composed of a direct voltage superimposed with an alternating voltage, a toner image forming unit configured to form a toner image on the charged surface, a current detection unit configured to detect a current flowing through the charging member applied with the charging bias from the applying unit, a plurality of extraction units configured to respectively extract currents of different predetermined frequency components from the current detected by the current detection unit when the charging bias is applied to the charging member, and an adjustment unit configured to adjust the alternating voltage of the charging bias based on the currents extracted by the plurality of extraction units, wherein a peak-to-peak voltage of the alternating voltage of the charging bias is a voltage where a discharge is generated between the charging member and the photosensitive member, and wherein when an area on which a toner image is formed by the toner image forming unit is charged by the charging member, the adjustment unit adjusts the alternating voltage of the charging bias based on the currents extracted from the plurality of extraction units.

Further features of the present invention will become apparent from the following description of exemplary embodiments with reference to the attached drawings.

DESCRIPTION OF THE EMBODIMENTS

The present invention will now be described in detail below with reference to the drawings showing preferred embodiments thereof.

(First Embodiment)

Figure 1:
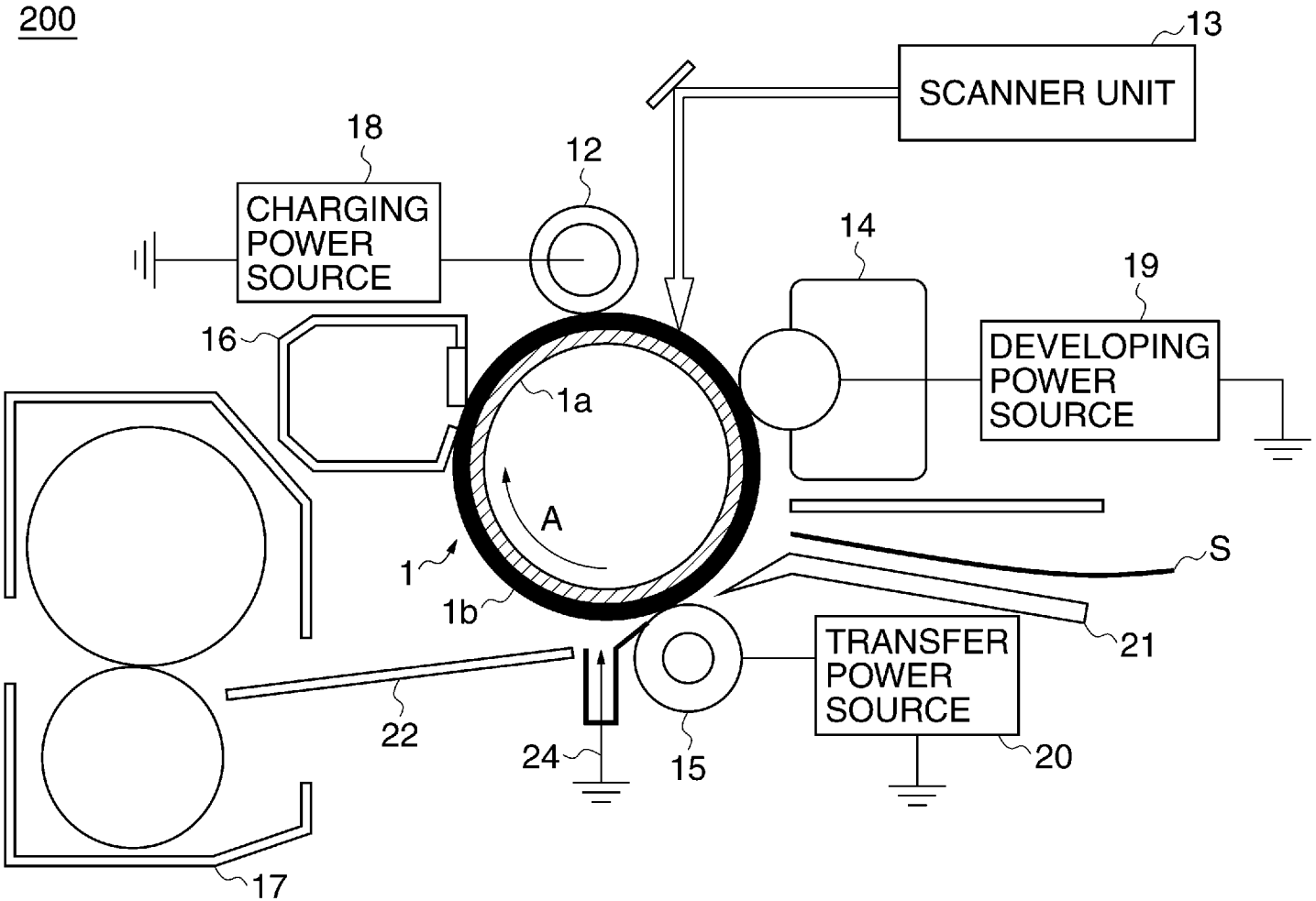
FIG. 1 is a view schematically showing the construction of an image forming apparatus according to a first embodiment of this invention.

FIG. 1 schematically shows the construction of an image forming apparatus 200 according to a first embodiment of this invention.

As shown in FIG. 1, the image forming apparatus 200 has a photosensitive member, e.g., a photosensitive drum 1, which serves as a to-be-charged member. The photosensitive drum 1 has an electrically-conductive support body la formed with a photosensitive layer lb. A charging roller 12 that serves as a charging member, a developing device 14, a transfer roller 15, a cleaner 16, and the like are disposed around the photosensitive drum 1 in a drum rotation direction denoted by arrow A. A scanner unit 13 is disposed above the photosensitive drum 1. The charging roller 12 for charging the photosensitive drum 1 is disposed in contact with or in the vicinity of the photosensitive drum 1.

A charging power source 18 serves as an applying unit that applies to the charging roller 12 a voltage for charging the photosensitive drum 1. More specifically, the charging power source 18 applies to the charging roller 12 a charging bias that is composed of a direct voltage superimposed with an alternating voltage. The alternating voltage of the charging bias has a peak-to-peak voltage that is set to a voltage where a discharge is generated between the charging roller 12 and the photosensitive drum 1. The peak-to-peak voltage has a value that is two times as large as a discharge starting voltage. The "discharge starting voltage" refers to an applied voltage at which a discharge is started between the charging roller 12 and the photosensitive drum 1 in a case where only the direct voltage is applied to the charging roller 12 while the direct voltage is increased.

A developing power source 19 supplies a developing bias to the developing device 14. A transfer power source 20 supplies a transfer bias to the transfer roller 15. A fixing device 17, conveyance guides 21-22, and a static eliminating needle 24 are also provided in the image forming apparatus 200.

Next, a description will be given of an image forming operation of the image forming apparatus 200.

At start of the image forming operation, the photosensitive drum 1 is driven by a drive unit (not shown) to rotate in the direction of arrow A. Then, a charging bias is applied from the charging power source 18 to a surface of the photosensitive drum 1 via the charging roller 12, whereby the drum surface is uniformly charged to a predetermined potential with a predetermined polarity.

Next, laser light modulated according to image information sent from an external information device (such as a personal computer) is irradiated from the scanner unit 13 to the drum surface, whereby the drum surface is exposed. As a result, electrical charges on exposed portions of the drum surface are removed, whereby an electrostatic latent image is formed on the surface of the photosensitive drum 1.

Next, a superimposed voltage of AC bias and DC bias is supplied from the developing power source 19 to the developing device 14, whereby a potential difference is formed between the developing device 14 and the electrostatic latent image on the photosensitive drum 1. Due to the potential difference, toner is transferred to the electrostatic latent image, so that a toner image is formed on an area of the photosensitive drum 1. The "area on which the toner image is formed" refers to an area on which the electrostatic latent image is formed by the scanner unit 13. The developing device 14 and the scanner unit 13 constitutes a toner image forming unit.

On the other hand, in synchronism with the toner image forming operation, a recording sheet S is conveyed from a sheet feed cassette (not shown) to a nip between the photosensitive drum 1 and the transfer roller 15 at a predetermined timing. A transfer bias is then applied from the transfer power source 20 to the transfer roller 15, whereby the toner image on the photosensitive drum 1 is transferred to a predetermined position of the recording sheet S.

The recording sheet S as a recording material carrying on its surface the unfixed toner image is electrostatically discharged by the static eliminating needle 24 which is grounded, whereby the recording sheet S is separated from the photosensitive drum 1 and introduced into the fixing device 17 along the conveyance guide 22. The recording sheet S is pressurized and heated in the fixing device 17, whereby the unfixed toner image is fixed to the recording sheet S. The recording sheet S fixed with the toner image is discharged to the outside of the image forming apparatus.

Toner not transferred to the recording sheet S but remaining on the surface of the photosensitive drum 1 is removed by the cleaner 16 so as to be ready for the next image formation.

Figure 2:
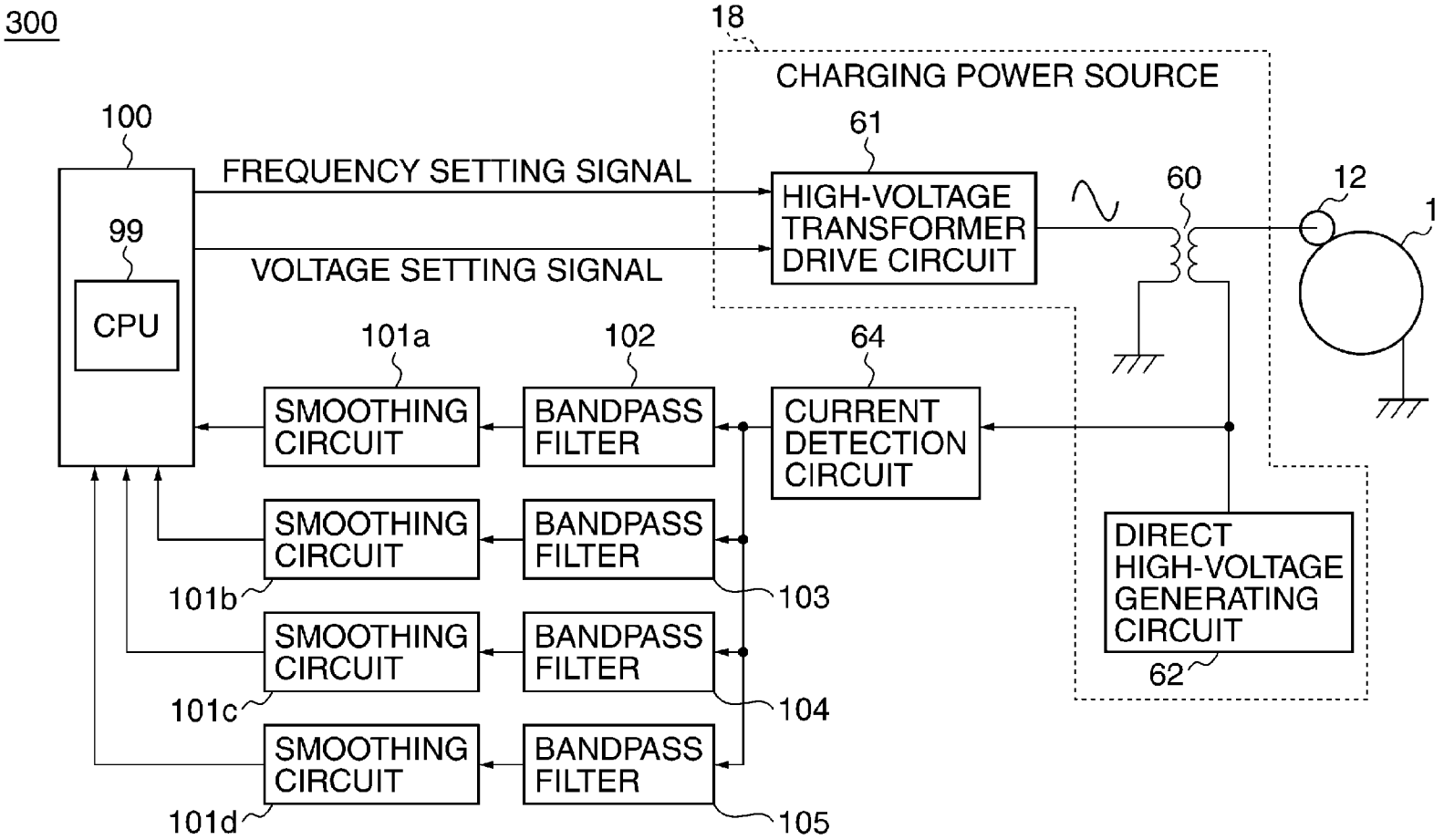
FIG. 2 is a block diagram schematically showing the construction of a control circuit of the image forming apparatus that controls the amount of a discharge current flowing from a charging roller to a photosensitive drum of the image forming apparatus.

FIG. 2 schematically shows the construction of a control circuit 300 that controls the amount of a discharge current flowing from the charging roller 12 to the photosensitive drum 1.

As shown in FIG. 2, the control circuit 300 includes a control unit 100 that serves as an adjustment unit. The control unit 100 has a CPU 99 and supplies a frequency setting signal and a voltage setting signal to the charging power source 18.

The charging power source 18 has a high-voltage transformer drive circuit 61 that generates a sinusoidal alternating voltage based on the frequency setting signal and the voltage setting signal that are supplied from the control circuit 100. The charging power source 18 also has a high-voltage transformer 60 that steps up the sinusoidal alternating voltage to an alternating high voltage, and a direct high-voltage generating circuit 62 that generates a direct high voltage. The generated direct voltage is superimposed with the alternating voltage stepped up by the high-voltage transformer 60, and the resultant voltage is applied as the charging bias to the charging roller 12.

The current detection circuit 64 serves as a current detection unit that detects a current flowing through the charging roller 12 (charging member) to which the alternating voltage is applied from the charging power source 18 serving as the applying unit. More specifically, the current detection circuit 64 detects by half or full wave rectification a current flowing through the charging roller 12 when voltages are respectively applied from the high-voltage transformer drive circuit 61 and from the direct high-voltage generating circuit 62.

A plurality of bandpass filters e.g. first to fourth bandpass filters 102-105 are connected to the output side of the current detection circuit 64. The bandpass filters 102-105 have passbands that are set to allow passage of integer-order frequency components of the alternating voltage applied to the high-voltage transformer 60, and are configured to be capable of respectively extracting currents of different predetermined frequency components.

More specifically, the passbands of the first to fourth bandpass filters 102-105 are respectively set so as to allow the passage of the first- to fourth-order frequency components. In other words, the integer-order frequencies passed by the bandpass filters 102-105 are different from one another.

First to fourth smoothing circuits 101*a*-101*d*, which are peak hold circuits, are connected to the output sides of the first to fourth bandpass filters 102-105, respectively. Outputs from the smoothing circuits 101*a*-101*d* are input to the control unit 100 via D/A ports (not shown) .

Figure 3:
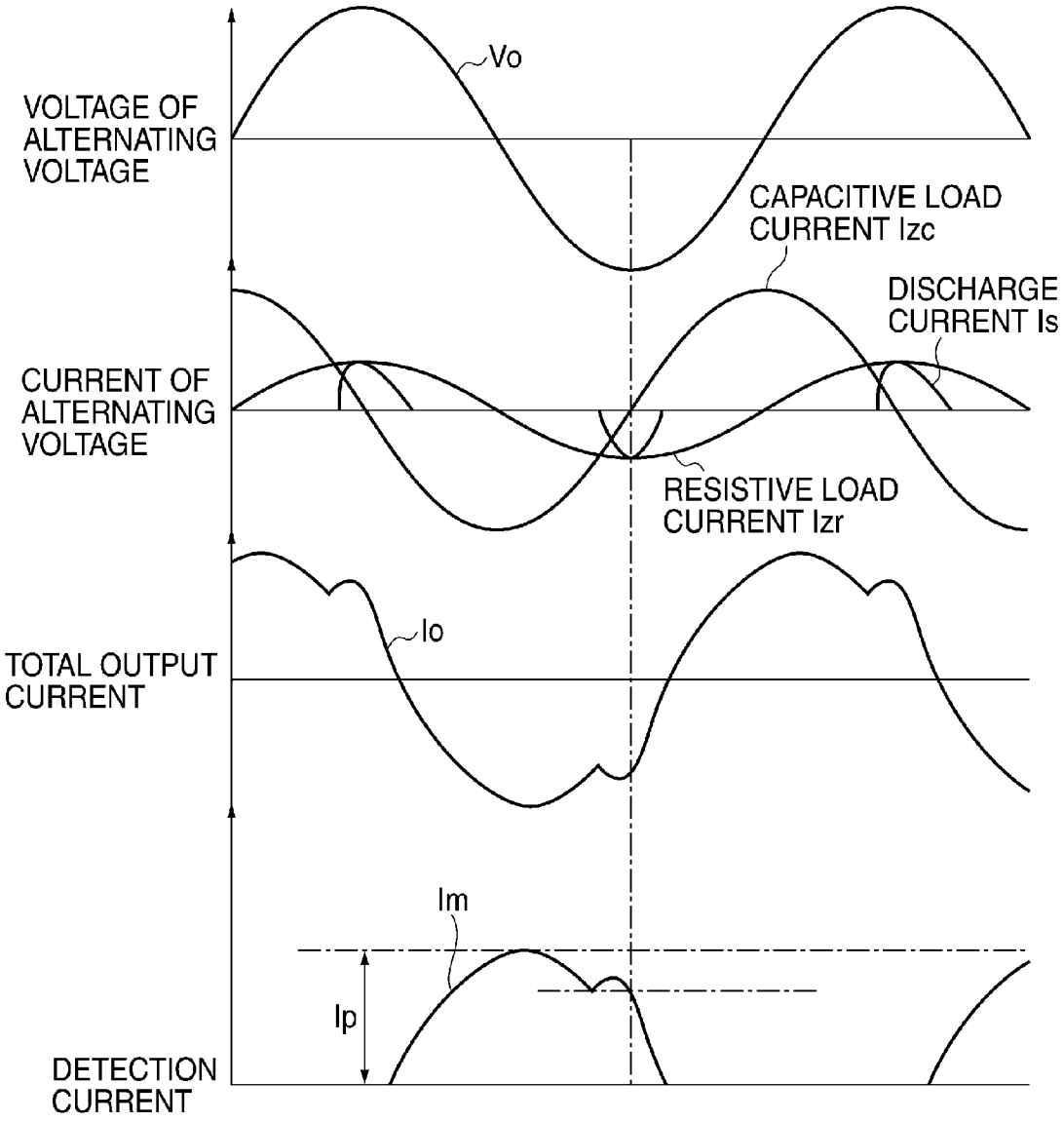
FIG. 3 is a view showing waveforms of voltage and current of an alternating voltage applied from a charging power source of the image forming apparatus to the charging roller and showing a waveform of a detection current detected by a current detection circuit of the control circuit.

FIG. 3 shows waveforms of voltage and current of an alternating voltage applied from the charging power source 18 to the charging roller 12 and shows a waveform of a detection current detected by the current detection circuit 64. In FIG. 3, the output voltage and output current of the charging power source 18 and the current detected by the current detection circuit 64 are taken along the ordinate. The abscissa is a time axis.

When the alternating voltage Vo shown in FIG. 3 is applied to the charging roller 12, a resistive load current Izr in phase with the alternating voltage Vo flows through a resistive load between the charging roller 12 and the photosensitive drum 1, and a capacitive load current Izc advanced in phase by 90 degrees from the alternating voltage Vo flows through a capacitive load between the charging roller 12 and the photosensitive drum 1. When the alternating voltage Vo has a peak voltage amplitude, a pulsive discharge current Is flows between the charging roller 12 and the photosensitive drum 1. In other words, a total output current Io represented by the sum of the resistive load current Izr, the capacitive load current Izc, and the discharge current Is flows through the charging roller 12.

A detection current waveform Im indicates a waveform of a current flowing from the charging roller 12 to the charging power source 18 and detected by the current detection circuit 64 in a case where an alternating current is half-wave rectified, which flows through the charging roller 12 when the alternating voltage is applied from the charging power source 18.

Figure 4:
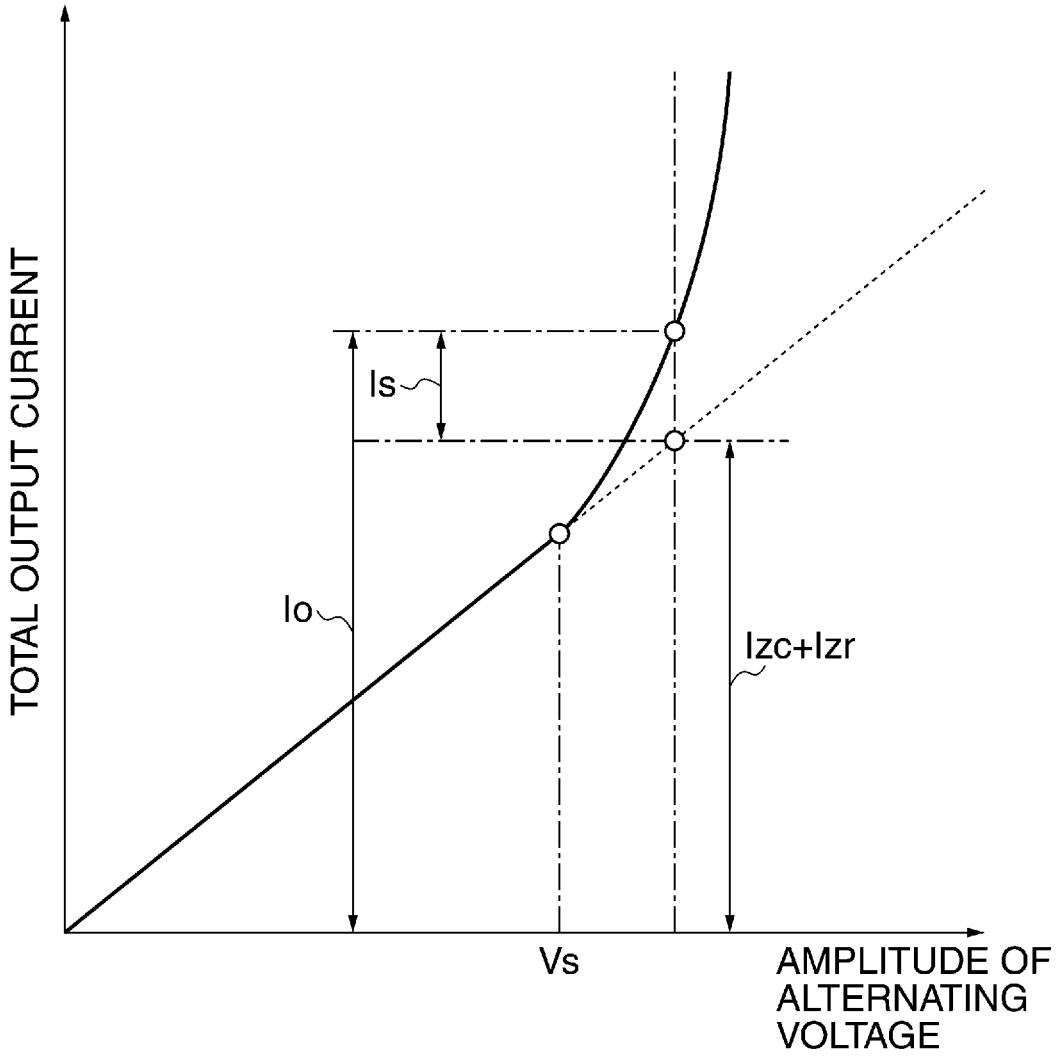
FIG. 4 is a view showing a relation between the amplitude of an alternating voltage applied from the charging power source to the charging roller and a total output current that is output from the charging power source.

FIG. 4 shows a relation between the amplitude of an alternating voltage applied from the charging power source 18 to the charging roller 12 and a total output current that is output from the charging power source 18.

In FIG. 4, the total output current is taken along the ordinate, and the amplitude (peak-to-peak voltage) of the alternating voltage is taken along the abscissa.

In an alternating voltage amplitude region shown in FIG. 4 where the amplitude of the alternating voltage applied to the charging roller 12 is equal to or less than a predetermined voltage amplitude Vs, a discharge phenomenon does not occur since the alternating voltage amplitude is small. Thus, the discharge current Is does not flow, and the total output current is represented by the sum of resistive load current Izr and capacitive load current Izc and varies substantially in proportion to the alternating voltage amplitude.

When the alternating voltage amplitude exceeds the predetermined voltage amplitude Vs, a discharge phenomenon starts to occur. Thus, in an alternating voltage amplitude region where the alternating voltage amplitude exceeds the predetermined voltage amplitude Vs, the total output current Io is represented by the sum of resistive load current Izr, capacitive load current Izc, and discharge current Is, and does not vary in proportion to the alternating voltage amplitude.

Figure 5:
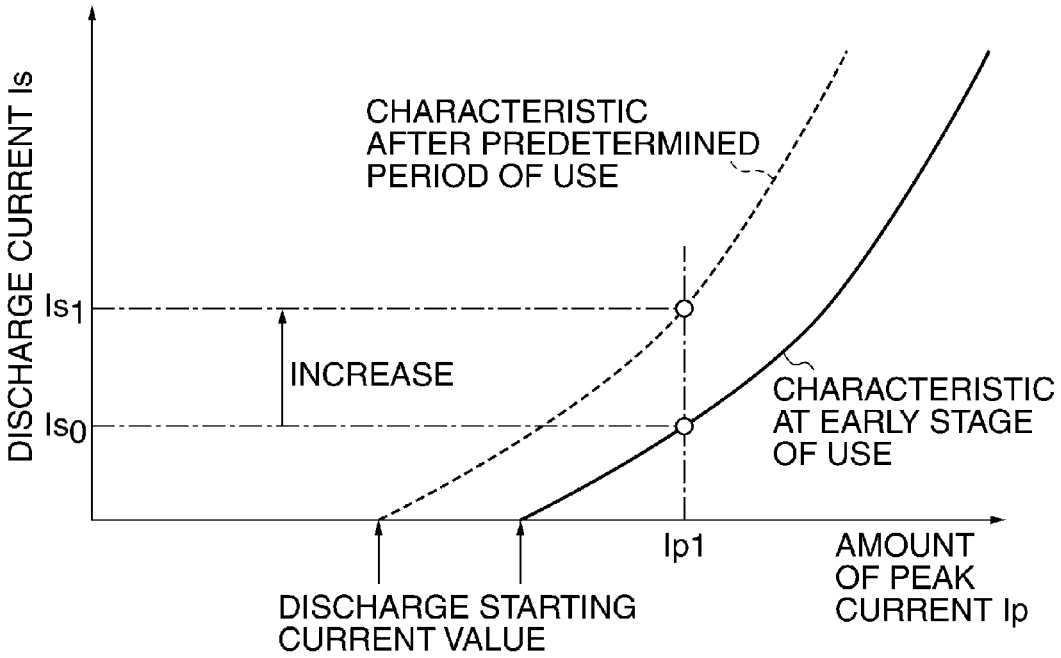
FIG. 5 is a view showing a relation between the amount of a peak current of the total output current applied from the charging power source to the charging roller and the amount of a discharge current flowing from the charging roller to the photosensitive drum.

FIG. 5 shows a relation between the amount of a peak current Ip of the total output current applied from the charging power source 18 to the charging roller 12 and the amount of a discharge current Is flowing from the charging roller 12 to the photosensitive drum 1. In FIG. 5, the amount of discharge current is taken along the ordinate, and the amount of peak current is taken along the abscissa.

In FIG. 5, a curved solid line indicates a relation between the amount of peak current Ip and the amount of discharge current Is at an early stage of use of the charging roller 12, and a curved dotted line indicates a relation therebetween after a predetermined period of use of the charging roller 12. With increasing period of use, the resistance of the charging roller 12 changes due to toner stains, and the resistance and electrostatic capacitance of the photosensitive drum 1 change due to decrease of the thickness of the photosensitive layer 1*b*. As a result, after the predetermined period of use, a discharge starting current value becomes smaller than that at an early stage of use, and the amount of discharge current at the same amount of peak current (e.g. Ip1) increases from a value of Is0 to a value of Is1.

Figure 6:
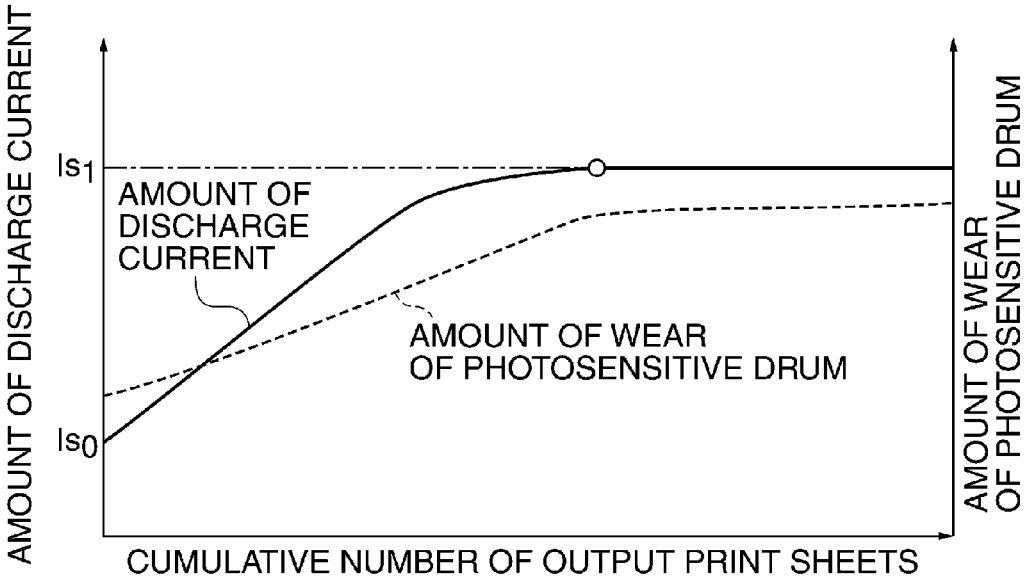
FIG. 6 is a view showing a relation between the amount of discharge current and the cumulative number of output print sheets and showing a relation between the amount of wear of the photosensitive drum and the cumulative number of output print sheets.

FIG. 6 shows a relation between the amount of discharge current and the cumulative number of output print sheets and shows a relation between the amount of wear of the photosensitive drum and the cumulative number of output print sheets. In FIG. 6, the amount of discharge current and the amount of wear of the photosensitive drum per 1000 sheets are taken along the ordinate, and the cumulative number of output print sheets is taken along the abscissa.

In a case where constant-current control is performed to attain a constant amount of peak current Ip of the total output current of the charging power source 18, the amount of discharge current increases from a value of Is0 at early stage of use to a value of Is1 after the predetermined period of use, as shown by a curved solid line in FIG. 6, with the increase of the cumulative number of output print sheets. The amount of wear of the surface of the photosensitive drum 1 proportionally increases with the increase of the amount of discharge current as shown by a curved dotted line in FIG. 6.

With the constant-current control, the amount of wear of the photosensitive drum 1 increases with the increase of the cumulative number of output print sheets, and the service life of the photosensitive drum 1 is shortened. To obviate this, in the present embodiment, the discharge current is directly controlled to suppress the wear of the photosensitive drum 1.

Figure 7:
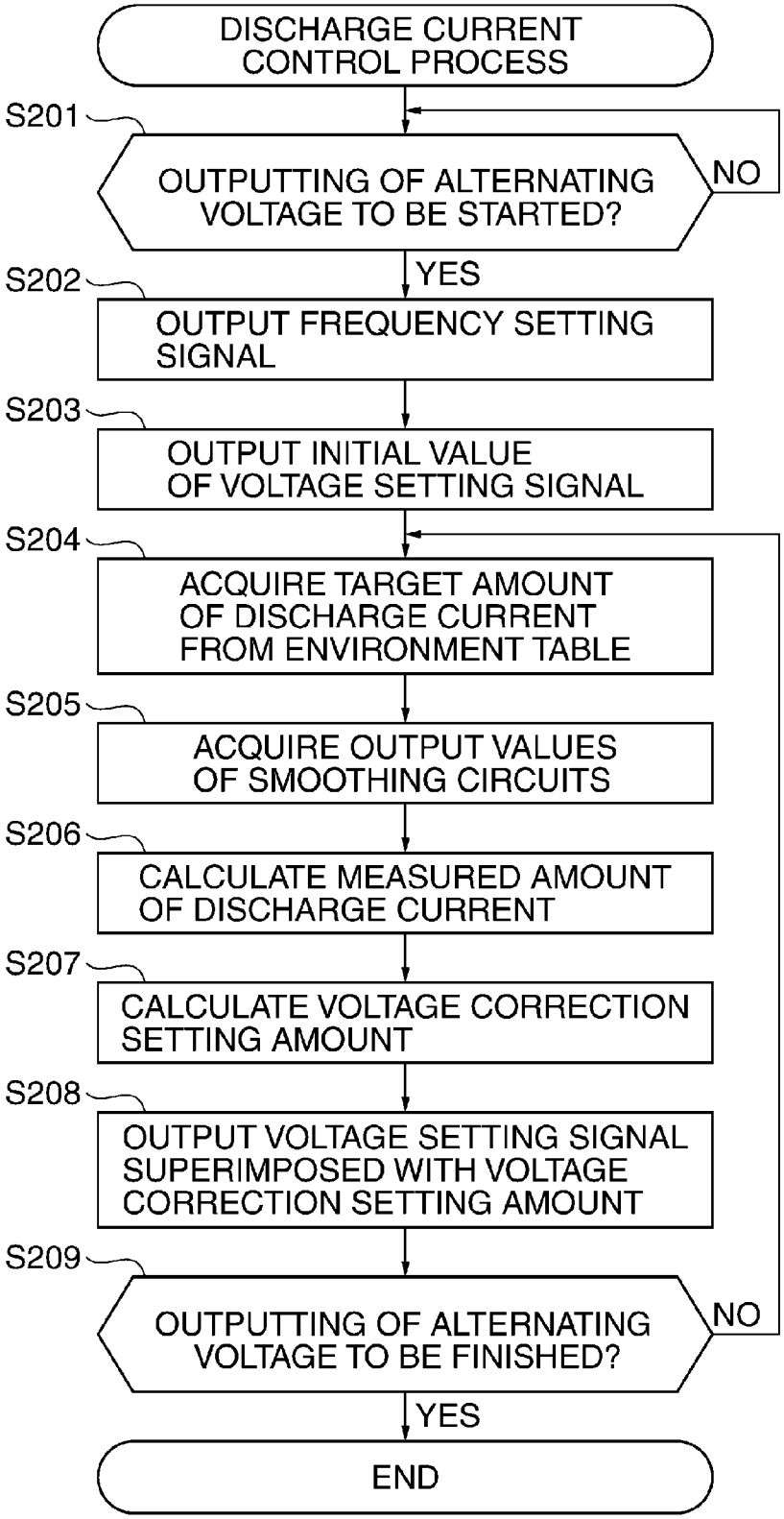
FIG. 7 is a flowchart showing procedures of a discharge current control process executed by the control unit.

FIG. 7 shows in flowchart the procedures of a discharge current control process executed by the control unit 100, which is the adjustment unit of the control circuit 300 shown in FIG. 2.

Referring to FIG. 7, the control unit 100 determines whether or not the outputting of the alternating voltage of the charging bias is to be started for image formation or for charging output adjustment (step S201). If determined that the outputting of alternating voltage is to be started (YES to step S201), the control unit 100 outputs to the high-voltage transformer drive circuit 61 of the charging power source 18 a frequency setting signal (clock) for setting the frequency of the alternating voltage and an initial value of the voltage setting signal for setting the level of the alternating voltage (steps S202 and S203).

Next, the control unit 100 acquires from an environment table a target amount of discharge current for realizing optimum charging (step S204). The target amount of discharge current is a predetermined target value determined in advance for control of the amount of discharge current flowing from the photosensitive drum 1 to the charging roller 12. Optimum values of the target amount of discharge current that vary depending on use environment and endurance history of the image forming apparatus 200 are determined in advance e.g. by experiments and stored in advance in the environment table.

In the charging power source 18, a charging operation has already been started based on the initial value of voltage setting signal supplied from the control unit 100 in step S202. Thus, an alternating current flowing through the charging roller 12 has been detected by the current detection circuit 64, and the detection current waveform shown in FIG. 3 has been obtained.

An output signal from the current detection circuit 64 is supplied to A/D conversion ports of the control unit 100 via the first to fourth bandpass filters 102-105 having passbands respectively set to allow the passage of the first- to fourth-order frequency components of the AC charging frequency and via the first to fourth smoothing circuits 101*a*-101*d*.

The CPU 99 of the control unit 100 serving as the adjustment unit and calculation unit acquires output values of the smoothing circuits 101*a*-101*d* (step S205), and calculates a measured amount H of discharge current (measured amount) according to formula (1) shown below (step S206). The measured amount H of discharge current is a linear sum of outputs of the bandpass filters 102-105 and indicates an amount of discharge current flowing from the charging roller 12 to the photosensitive drum 1.

$$H=K_1V_1+K_2V_2+K_3V_3+K_4V_4+C \quad (1)$$

In formula (1), symbols $V_1$ to $V_4$ respectively denote outputs of the first to fourth bandpass filters 102-105, and $K_1$ to $K_4$ and C respectively denote coefficients determined in advance by experiments.

By determining the measured amount H from the linear sum of outputs of the bandpass filters 102-105, a measured amount coincident well with an actual amount of discharge current can be obtained, even if the discharge current is detected after being half-wave rectified by using a low-priced circuit and/or even if a distortion is originally present in the discharge current waveform.

Next, the control unit 100 calculates a voltage correction setting amount to be applied to the voltage setting signal to decrease a difference between the measured amount H of discharge current and the target amount of discharge current (step S207), and outputs the voltage setting signal superimposed with the voltage correction setting amount to the high-voltage transformer drive circuit 61 of the charging power source 18 (step S208). Step S208 corresponds to control performed by the adjustment unit that controls the alternating voltage applied from the charging power source 18 based on measured amount of discharge current determined from bandpass filter outputs and based on a reference amount, which is a predetermined target value determined in advance for control of the amount of discharge current flowing from the charging roller 12 to the photosensitive drum 1.

Next, the control unit 100 determines whether or not the outputting of the alternating voltage is to be finished (step S209). If the answer to step S209 is YES, the discharge current control process is completed. On the other hand, if the answer to step S209 is NO, the flow returns to step S204.

More specifically, the voltage setting signal is sequentially corrected at intervals of execution cycle of the discharge current control process during the period from start to end of the outputting of alternating voltage, i.e., during the period from start to end of the charging of the photo sensitive drum 1. For adjustment of the alternating voltage, the peak-to-peak voltage of the alternating voltage can be adjusted. Instead, a constant-current value can be adjusted in a case where the alternating voltage is controlled by constant-current control. In this embodiment, with the above-described process, the amount of discharge current can properly be controlled in real time.

Next, a description will be given of why the measured amount H of discharge current is determined from the linear sum of outputs of the bandpass filters 102-105.

Figure 8A:
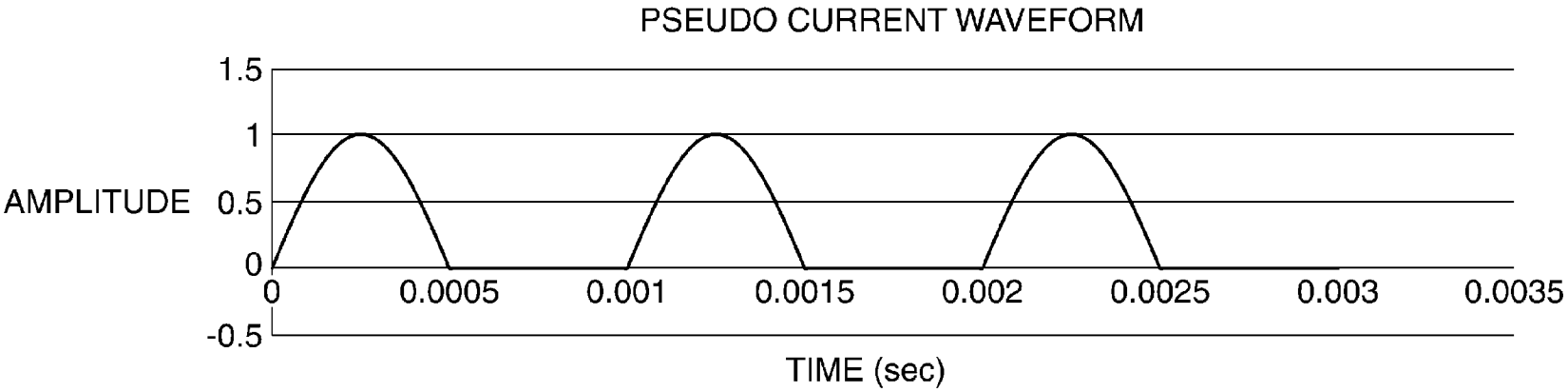
FIG. 8A is a view showing a waveform of a pseudo current generated in a comparison example.
Figure 8B:
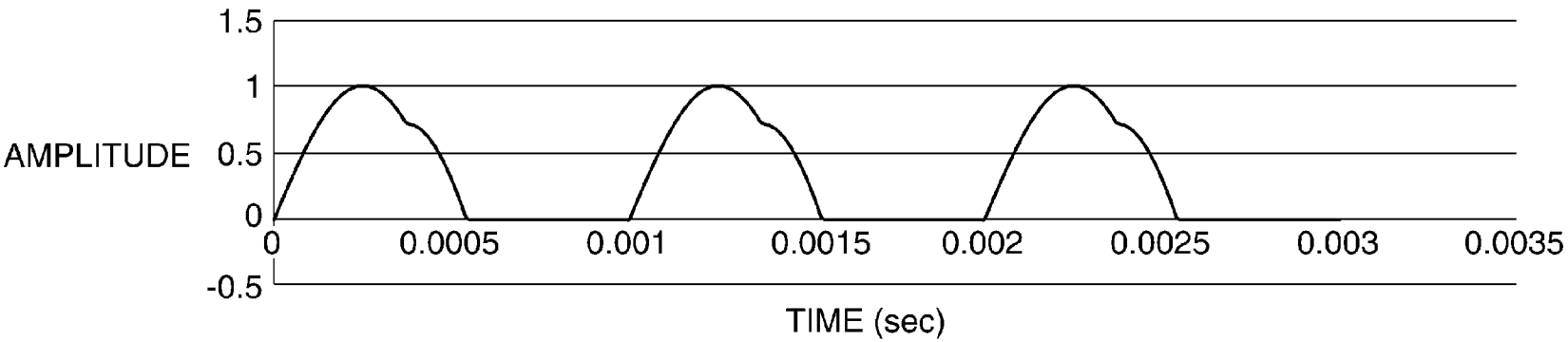
FIG. 8B is a view showing a waveform of a detection current detected in the comparison example.

FIG. 8A shows a waveform of a pseudo current generated in a comparison example, and FIG. 8B shows a waveform of a detection current detected in the comparison example. In FIGS. 8A and 8B, amplitudes of the waveforms are taken along the ordinate, and the abscissa is the time axis.

Figure 9A:
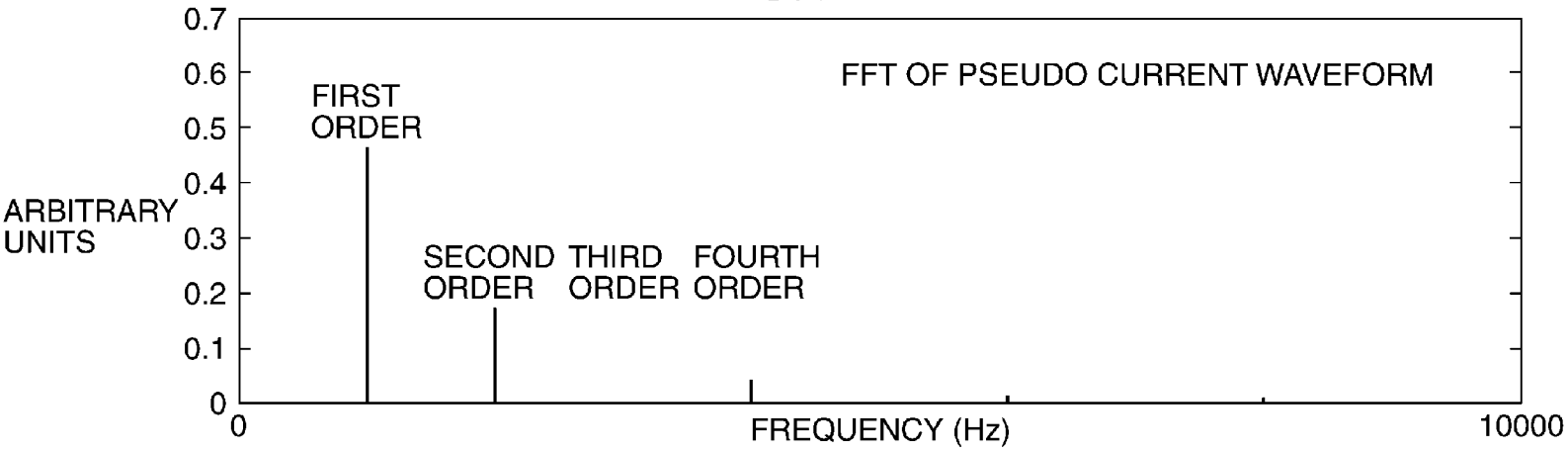
FIG. 9A is a view showing a Fourier transformation spectrum of the pseudo current waveform shown in FIG. 8A.
Figure 9B:
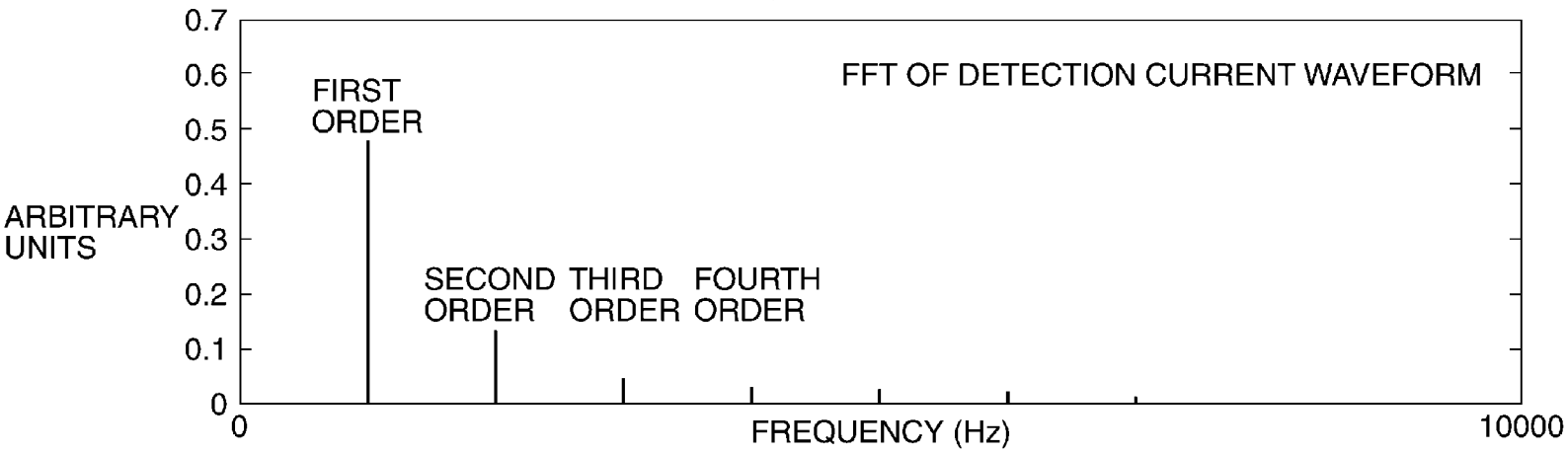
FIG. 9B is a view showing a Fourier transformation spectrum of the detection current waveform shown in FIG. 8B.

FIG. 9A shows a Fourier transformation spectrum of the pseudo current waveform of FIG. 8A, and FIG. 9B shows a Fourier transformation spectrum of the detection current waveform of FIG. 8B. In FIGS. 9A and 9B, frequency component is taken along the ordinate, and frequency is taken along the abscissa.

The detection current waveform of FIG. 8B is represented by the sum of resistive load current Izr, capacitive load current Izc, and discharge current Is (see, FIG. 3). To extract the amount of discharge current from the detection current waveform, the resistive load current Izr and capacitive load current Izc must be separated from the detection current waveform. To this end, in the comparison example, the pseudo current waveform that represents the resistive load current and capacitive load current is generated as shown in FIG. 8A, and a difference between the pseudo current waveform of FIG. 8A and the detection current waveform of FIG. 8B is determined to thereby extract the amount of discharge current.

As understood from FIGS. 9A and 9B, the difference between the detection current waveform and the pseudo current waveform that represents the amount of discharge current mainly appears in the second-order and higher-order frequency components.

In other words, the amount of discharge current can be extracted from the detection current waveform by detecting integer-order frequency components of the AC charging frequency of the detection current waveform in real time. This technique is utilized in the present embodiment in the calculation to determine, while taking into consideration e.g. the presence of a distortion in the discharge current waveform, the measured amount H of discharge current from the linear sum of outputs of the bandpass filters 102-105 according to formula (1).

As described above, according to this embodiment, it is possible to perform the adjustment of alternating voltage for attaining a proper amount of discharge current in real time in the period in which the charging operation is being performed for image formation.

(Second Embodiment)

In the following, a description will be given in detail of an image forming apparatus according to a second embodiment of this invention.

The image forming apparatus of this embodiment is the same as that of the first embodiment, except for the construction of a control circuit for controlling the amount of discharge current, and a description of points common to these embodiments will be omitted.

Figure 10:
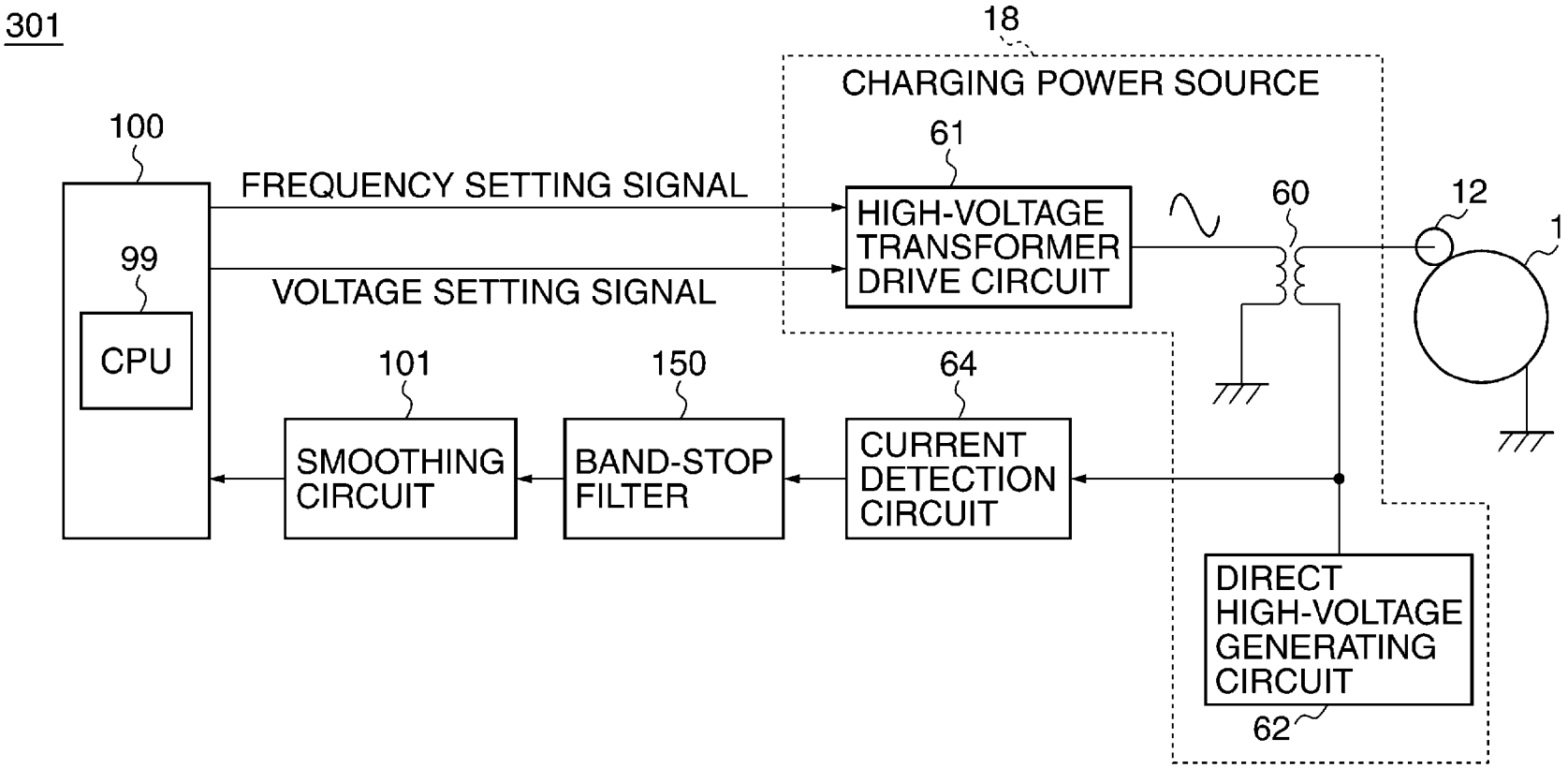
FIG. 10 is a block diagram schematically showing the construction of a control circuit of an image forming apparatus according to a second embodiment of this invention that controls the amount of a discharge current in the image forming apparatus.
Figure 11A:
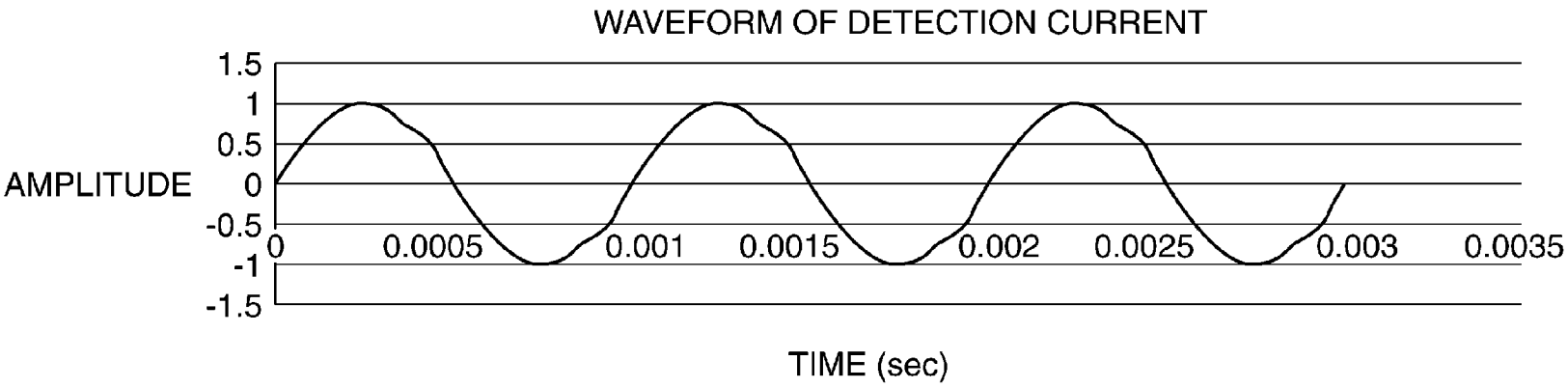
FIG. 11A is a view showing a waveform of a detection current detected by a current detection circuit of the control circuit.
Figure 11B:
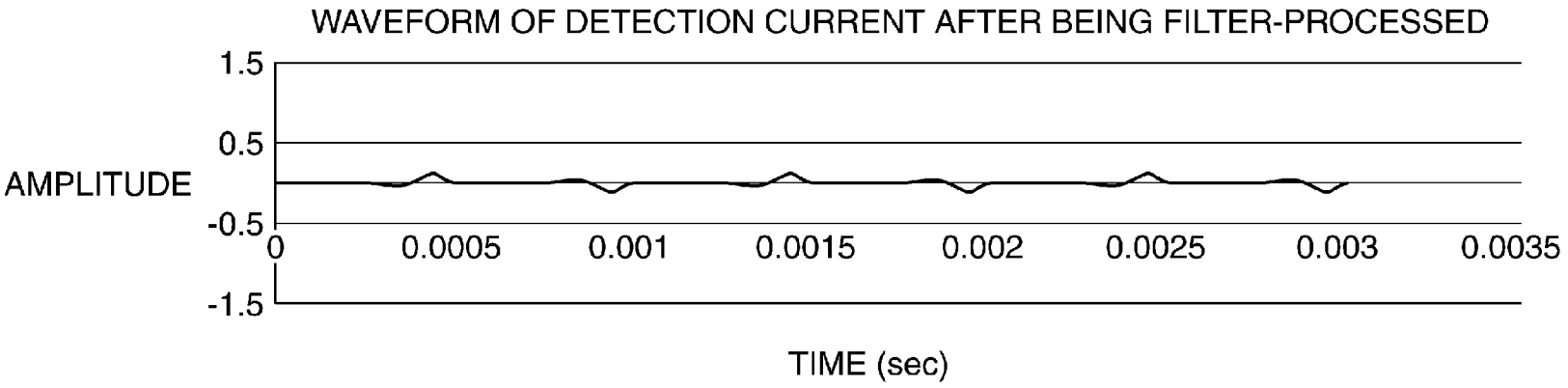
FIG. 11B is a view showing a waveform of the detection current after being filter-processed by a band-stop filter of the control circuit.

FIG. 10 schematically shows the construction of a control circuit 301 that controls the amount of a discharge current in this embodiment. FIG. 11A shows a waveform of a detection current detected by a current detection circuit of the control circuit 301, and FIG. 11B shows a waveform of the detection current after being filter-processed by a band-stop filter of the control circuit 301.

The control circuit 301 of this embodiment includes the control unit 100 and the current detection circuit 64 as with the control circuit 300 of the first embodiment. The control circuit 301 includes a band-stop filter 150 and a smoothing circuit 101, instead of the bandpass filters 102-105 and the smoothing circuits 101*a*-101*d* of the control circuit 300.

The band-stop filter 150 is connected to the output side of the current detection circuit 64 and has a stopband that prevents the passage of the first-order frequency component of the AC charging frequency. The band-stop filter 150 supplies an output well representing the amount of discharge current and shown in FIG. 11B to the control unit 100 via the smoothing circuit 101.

The control unit 100 executes a discharge current control process as with the first embodiment. The CPU 99 of the control unit 100 acquires an output value of the smoothing circuit 101 instead of acquiring output values of the smoothing circuits 101*a*-101*d* in step S205 of the discharge current control process of FIG. 7, and uses the acquired output value as the measured amount of discharge current (measured amount). Next, the control unit 100 calculates a voltage correction setting amount for decreasing a difference between the measured amount and the target amount of discharge current, and outputs to the charging power source 18 a voltage setting signal superimposed with the voltage correction setting amount. The control circuit 301 of this embodiment is suitable for a case where a distortion is not present in the detection current waveform.

As described above, according to this embodiment, the amount of discharge current that varies according to the endurance history and use environment of the image forming apparatus can be detected in real time and can always be properly maintained by the circuit arrangement including the band-stop filter 150, which is simple in construction and low-priced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-261003, filed Nov. 29, 2012, which is hereby incorporated by reference herein in its entirety.

What is claimed is:

1. An image forming apparatus comprising:

a photosensitive member;

a charging member configured to charge said photosensitive member;

an applying unit configured to apply a charging bias to said charging member, the charging bias composed of a direct voltage superimposed with an alternating voltage, wherein a peak-to-peak voltage of the alternating voltage of the charging bias is a voltage where a discharge is generated between said charging member and said photosensitive member;

a toner image forming unit configured to form a toner image on a charged surface charged by said charging member;

a current detection unit configured to detect a current flowing through said charging member applied with the charging bias from said applying unit;

an extraction portion configured to extract a plurality of outputs regarding a plurality of currents from the current detected, the plurality of currents having different frequency components;

a calculation unit configured to calculate an amount of discharge current based on the plurality of outputs extracted by said extraction portion; and an adjustment unit configured to adjust the alternating voltage of the charging bias such that the amount of discharge current calculated by said calculation unit is equal to a predetermined amount of discharge current.

2. The image forming apparatus according to claim 1, wherein said adjustment unit adjusts the peak-to-peak voltage of the alternating voltage of the charging bias.

3. The image forming apparatus according to claim 1, wherein the calculation unit calculates a linear sum by multiplying outputs of said extraction portion by coefficients, wherein said adjustment unit adjusts the alternating voltage of the charging bias based on a difference between the linear sum and a predetermined target value.

4. The image forming apparatus according to claim 3, wherein said adjustment unit adjusts the alternating voltage so as to decrease the difference between the linear sum and the predetermined target value.

5. The image forming apparatus according to claim 3, wherein the linear sum indicates an amount of discharge between said charging member and said photosensitive member.

6. The image forming apparatus according to claim 1, wherein the predetermined frequency components are integer-order frequency components of the alternating voltage of the charging bias.

* * * * *